US005749971A

United States Patent [19]

Ni

[11] Patent Number: 5,749,971

[45] Date of Patent: May 12, 1998

[54] APPARATUS FOR MAKING A WELDING FLUX COATING CONTINOUSLY ON A WELDING ELECTRODE

[76] Inventor: Chong Yang Ni, 75 Springbrook Dr., Richmond Hill, Ontario, Canada, L4B 3R3

[21] Appl. No.: 623,111

[22] Filed: Mar. 28, 1996

[51] Int. Cl.[6] ..... B05C 3/02; B05C 3/12

[52] U.S. Cl. ..... 118/407; 118/410; 118/420; 118/DIG. 12; 118/DIG. 19

[58] Field of Search ..... 118/407, 410, 118/420, DIG. 18, DIG. 19, DIG. 22, DIG. 11, DIG. 12, DIG. 13

[56] References Cited

U.S. PATENT DOCUMENTS

| | | | |
|---|---|---|---|
| 3,619,429 | 11/1971 | Torigai | 264/23 |
| 4,505,222 | 3/1985 | Holt et al. | 118/304 |
| 4,773,954 | 9/1988 | Starnes, Jr. | 156/244 |
| 5,031,568 | 7/1991 | Milliman | 425/113 |
| 5,160,451 | 11/1992 | Fickling et al. | 118/405 |
| 5,183,669 | 2/1993 | Guillemette | 425/113 |
| 5,399,196 | 3/1995 | Ichikawa et al. | 118/407 |

*Primary Examiner*—Donald E. Czaja
*Assistant Examiner*—Jacqueline A. Ruller
*Attorney, Agent, or Firm*—David W. Wong

[57] ABSTRACT

Welding electrodes are continuously coated with a flux material with this pressure coating system. The flux material is supplied to the coating station by two supply bins which are automatically controlled such that the flux material is always supplied to the coating station. While one supply bin is supplying the flux material to the coating station the other bin is being replenished in an alternate manner.

10 Claims, 1 Drawing Sheet

APPARATUS FOR MAKING A WELDING FLUX COATING CONTINOUSLY ON A WELDING ELECTRODE

BACKGROUND OF THE INVENTION

This invention relates to a method and apparatus for pressure coating welding electrodes with a flux material.

Welding electrodes may have the flux material coated on their outer surface. Commonly, two coating methods are employed for providing the welding flux material over the surface of welding electrodes, namely, the spiral coating and the pressure fluid coating methods. The spiral method has been initially widely employed due to its simplicity. In such spiral coating method, the flux material is deposited in a spiral manner without pressure onto the surface of the electrode and the material is retained on the surface of the electrode by adhesion. Although the spiral method is simple to carry out, the coated electrode is low in quality due to the low adhesion of the spiral coating to the electrode surface, so that it can disband from the electrode easily. Thus, unreliable adhesion of the flux coating to the electrode often results in an unsatisfactory weld due to the undesirable loss of the welding flux material during the welding operation. In the pressure coating method, the welding flux material in a fluid form is applied under pressure onto the surface of the electrode to obtain a strong bond between the coating material and the electrode. The mixture of flux material is fed under pressure from a supply station to a pressure coating chamber in which the metal core of the welding electrode is located so that the flux material bonds with the metal core intimately.

A common drawback in the pressure coating method is that the process must be temporarily disrupted for replenishing the coating flux material in the coating system when the flux material in the supply station has been depleted. A considerable time is required to shut down the process, in order to replenish the supply station and to increase the coating pressure in the supply station back to the operating level. Therefore, it results in a considerable unnecessary down time of the coating process and inherent wastage of the partially coated material and/or electrode when the process is abruptly terminated. An attempt has been made to overcome the above drawback by employing two complete coating systems in parallel, such that when one system is down, the other system is quickly turned on to resume the coating process. However, such arrangement still requires considerable time to switch from one system to the other, and the wastage of material still exists. Also, additional time is required to increase the pressure of the second system to the operating level. Furthermore, the dual system is costly to build due to the requirement of requiring twice as many components as the common single system, and yet the coating process still can not be truly continuously carried out.

SUMMARY OF THE INVENTION

It is a principal object of the present invention to provide a continuous pressure coating process for welding electrodes.

It is another object of the present invention to provide a continuous welding electrode coating system in which the coating flux material is supplied continuously under operating pressure to the coating station.

It is another object of the present invention to provide a continuous welding electrode coating system in which the coating flux material is replenished without having to terminate the coating process.

It is yet another object of the present invention to provide a continuous welding electrode coating system which is relatively simple to operate.

It is still another object of the present invention to provide a continuous welding electrode coating system which has very low wastage of material.

The invention primarily is achieved by the provision of two pressurizable coating material supply bins. The supply bins are coupled to the coating station through an automatically controlled supply valve system such that while one system is supplying the flux material to the coating station, the other supply bin is completely shut off from communicating with the coating station, so that it may be depressurized for replenishment and be brought back to the operating pressure level ready for the coating process without affecting or disrupting the flux material coating operation. As soon as the coating material in the first supply bin is depleted the control valve automatically allow the flux material to be fed from the pressurized second supply bin to be coupled to the coating station to continue the coating process while simultaneously shutting the first supply bin from the coating station for replenishment and brought up to the operating pressure level ready for operation. Thus the two supply bins alternately and continuously supplying the flux material to the coating station to carry out the coating process without any disruption.

DETAILED DESCRIPTION OF AN EXEMPLARY EMBODIMENT OF THE INVENTION

Figure 1:
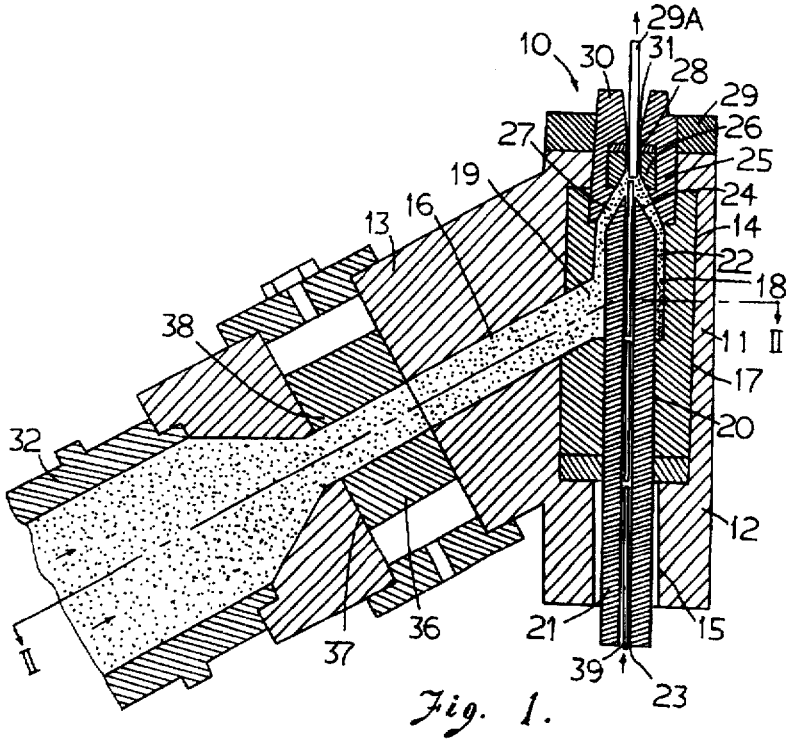
FIG. 1 is a cross sectional side elevation view of the coating system according to the present invention.
Figure 2:
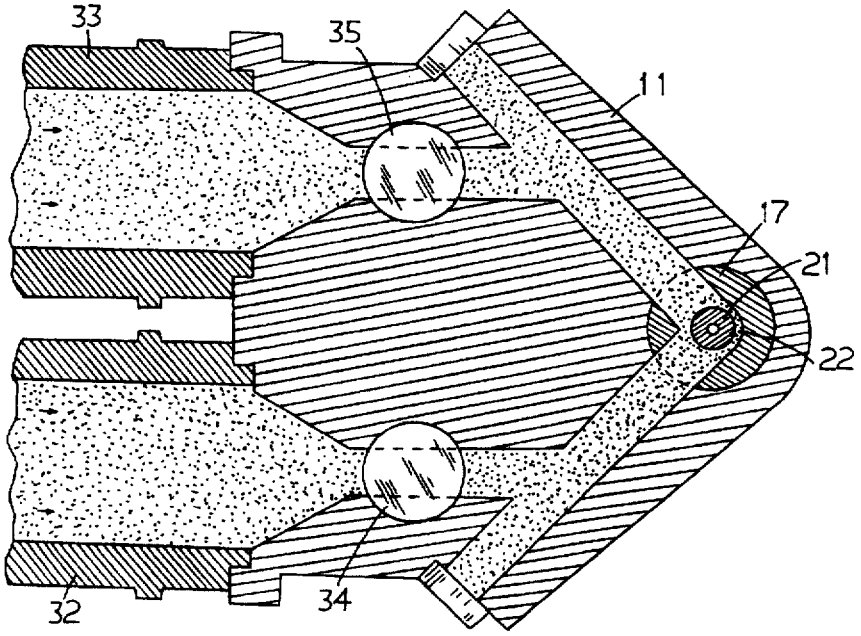
FIG. 2 is a cross sectional top elevation view along cross section line II—II in FIG. 1 thereof.

Referring to the drawings wherein like reference numerals in the various views designate the same components parts, welding electrode coating station 10 has a cast body 11 which has a lower extension portion 12 and a side extension portion 13. A cylindrical chamber 14 is located in the centre of the cast body 11. A vertical through opening 15 extending through the lower extension portion 12 into the cylindrical chamber 14, and also an oblique duct opening 16 extending through the side extension portion 13 into the cylindrical chamber 14. A liner 17 is provided in the cylindrical chamber 14. The liner 17 has an upper chamber 18 which communicates with the oblique duct opening 16 through a side opening 19 and with the vertical through opening 15 through a narrow lower opening 20. An elongated cylindrical guide member 21 extends through the vertical through opening 15 into the upper chamber 18 of the liner 17. The cylindrical guide member 21 is mounted in place by engaging with the narrow lower opening 20 of the liner 17. An annular chamber 22 is thus formed in the upper chamber 18 between the cylindrical guide member 21 and the liner 17. The cylindrical guide member 21 has a longitudinal through opening 23 extending through the entire length therein. The diameter of the through opening 23 is equal to or slightly larger than the diameter of the bare metal core of the welding electrode such that a metal core may be passed therethrough. The cylindrical guide member 21 has a conical tip 24 formed at its upper end. An annular sleeve 25 is mounted at the top portion of the upper chamber 18 of the liner 17 and an inner moulding sleeve 26 is mounted to the annular sleeve 25 such that the combination of the annular sleeve 25 and the inner moulding sleeve 26 forms a composite unit mounted at the top portion of the upper chamber 18 of the liner 17. The composite unit has a bottom conical depression 27 complementary to the shape of the conical tip 24 of the elongated guide member 21 and spaced therefrom to form a continuation of the annular chamber 22 in the upper chamber 18. The composite unit has a central opening 28 extending therethrough. The central opening 28 has a diameter equal to the diameter of the coated welding electrode. The central opening 28 forms the coating station at which the welding flux material is coated onto the metal core of the electrode passing therethrough. The longitudinal through opening 23 of the guide member 21 is aligned with the central opening 28 of the coating station so that metal core passing through the longitudinal through opening 23 of the guide member 21 is guided by the guide member 21 to pass through the coating station. The top of the cast body 11 is enclosed by a top cover 29. A separate sleeve 30 may be mounted at the centre of the top cover 29. The separate sleeve 30 has an opening 31 extending therethrough and upwards from the coating station. The lower portion of the opening 31 has a diameter equal to the diameter of the coated welding electrode 29A, and it preferably has a divergent bell-shaped upper portion as best shown in FIG. 1 in order to facilitate the drying process of the flux coating as the coated electrode passes upwards therethrough leaving the coating station.

At least two welding flux material supply bins 32 and 33 are coupled to the side extension portion 13 of the cast body. These supply bins provide the welding flux material under the desirable pressure level to the coating station, and control valves 34 and 35 are provided between the supply bins 32 and 33 to the side extension portion 13. The control valves 34 and 35 may consists of a piston 36 slidably mounted in a channel 37 extending transverse to the oblique duct opening 16. The piston 36 has a transverse through opening 38 formed therein such that the piston 36 may be positioned with the through opening 38 aligned with the oblique duct opening 16 so that the welding flux material in the supply bin may pass under pressure therethrough into the annular chamber 22, or alternately the piston 36 may be slidably moved to the position in the channel 37 at which the through opening 38 is entire off-set from the oblique duct opening 16 so that the supply bin is completely shut off from the annular chamber 22. When the control valve 34 is positioned to allow the supply bin 32 to communicate with the annular chamber 22, the control valve 35 is at the shut off position such that the supply bin 33 may be de-pressurized for replenishment when the flux material therein has been depleted, and/or for maintenance purposes. Alternately, when the control valve 35 is positioned to allow the supply bin 33 to communicate with the annular chamber 22, the control valve 34 is at the shut off position for de-pressurizing and replenishing the supply bin 32. The operation is alternately actuated so that the welding flux material is continuously supplied under the desirable pressure level to the coating station through the annular chamber 22. A plurality of supply bins and associated control valves may be provided such that a single supply bin or several supply bins may be selected to supply the welding flux material continuously to the coating station at one time and alternately without disrupting the coating process.

The metal core rods 39 are continuously fed through the through opening 23 of the elongated guide member 21 to pass through the coating station while the welding flux material is fed under pressure to the coating station through the annular chamber 22. The elongated guide member 21 also serves to guide the metal core rod 39 towards the coating station as well as securely maintaining the metal core rod 39 in place while it is being coated.

Obviously, numerous modifications and variations of the present invention are possible in light of the above teachings. It is therefore to be understood that within the scope of the appended claims, the invention may be practised otherwise than as specifically described herein.

What I claimed is:

1. A coating apparatus for continously applying a single layer of welding flux material mixture to an elongated metal core passing through a coating station comprising, a cast body having said coating station mounted at a top portion therein, said coating station being in communication with an annular chamber located within said cast body, an elongated guide member mounted in said cast body and having an elongated opening extending throughout the entire longitudinal length therein and being operative for guiding said metal core towards said coating station, at least two supply bins coupled to said cast body and containing the same said welding flux material mixture, and adapted to supply said welding flux material mixture from one bin at a time alternately to said coating station, a sliding control valve member connected to said supply bins and to said cast body, said control valve member being operative to connect said supply bins, one bin at a time, alternately and selectively to said annular chamber for supplying said welding flux material mixture to said coating station from one supply bin, while simultaneously closing communication of the second supply bin from said annular chamber.

2. A coating apparatus according to claim 1 wherein said elongated opening in said guide member has a diameter equal to the diameter of said metal core.

3. A coating apparatus according to claim 2 wherein said supply bins communicate with said annular chamber through ducting channels formed in said cast body and said sliding control valve member comprises piston members slidably mounted in a control channel extending transverse to said ducting channels.

4. A coating apparatus according to claim 3 wherein each one of said piston members has a transverse through opening formed therein, said piston members being operative slidably and selectively to position said transverse through opening of one of said piston members to align with one of said ducting channels and simultaneously to position said transverse through opening of the other one of said piston members to off-set with the other one of said ducting channels.

5. A coating apparatus for continuously applying a single layer of welding flux material coating to a metal core to form a coated welding electrode, comprising a cylindrical cast body having a lower extension portion and a side extension portion, and a cylindrical inner chamber located within said cast body, an annualar sleeve member mounted at a top portion of said inner chamber and operative as a coating station of said metal core, said annular sleeve member having a central through opening with a diameter equal to the diameter of a coated welding electrode, oblique ducts formed in said side extension portion of said cast body, and a vertical through opening formed in said lower extension portion of said cast body, an elongated guide member mounted to said cast body and extending into said inner chamber through said vertical through opening of said lower extension portion of said cast body, said guide member having a longitudinal opening extending throughout the entire longitudinal length therein and being operative for guiding said metal core towards said central through opening of said annular member, two pressurizable welding flux material supply bins coupled to said cast body, and adapted to supply same said welding flux material mixture alternately, one bin at a time, to said coating station, a sliding control valve member disposed between said supply bins and said cast body and being operative selectively and alternately to open communication of one of said supply bins from said coating station, and simultaneously closing communication of the other one of said supply bins from said coating station.

6. A coating apparatus according to claim 5 including an annular chamber formed between said guide member and the inside wall of said cast body, said annular chamber being in communication with said oblique ducts and said coating station.

7. A coating apparatus according to claim 6 wherein said control valve member comprises two piston members slidably mounted in mounting channels located transverse to said oblique ducts, each one of said piston members having a transverse through opening formed therein, and said piston members being operative slidably and selectively to locate said transverse through opening of one of said piston members to align with one of said oblique ducts while the transverse through opening of the other one of said piston members is off-set with the other one of said oblique ducts.

8. A coating apparatus according to claim 7 wherein said longitudinal opening in said guide member has a diameter equal to the diameter of said metal core, and said longitudinal opening being aligned with said central through opening in said annular sleeve member.

9. A coating apparatus according to claim 8 wherein said guide member has a conical tip and said annular sleeve member has a conical bottom depression therein spaced from said conical tip of said guide member.

10. A coating apparatus according to claim 9 including a top cover member disposed over said cast body, said top cover member having a central opening extending upwards and aligned with said coating station, said central opening having a bell-shaped upper portion extending upwards therefrom.

* * * * *